United States Patent [19]

Bonk

[11] Patent Number: 5,014,951

[45] Date of Patent: May 14, 1991

[54] VALANCE SPACER ASSEMBLY

[76] Inventor: Daniel Bonk, 4859 N. Cumberland, Norridge, Ill. 60656

[21] Appl. No.: 475,029

[22] Filed: Feb. 5, 1990

[51] Int. Cl.[5] ..... F16L 3/00

[52] U.S. Cl. ..... 248/231.8; 160/38; 248/253; 248/263

[58] Field of Search ..... 248/214, 231.8, 221.3, 248/222.1, 274, 300, 301, 323, 916, 909, 544, 251, 263, 261, 61, 253, 101; 160/38, 39

[56] References Cited

U.S. PATENT DOCUMENTS

| | | | |
|---|---|---|---|
| 1,843,888 | 2/1932 | Supa | 248/253 |
| 2,513,628 | 7/1950 | Eaglin | 160/39 |
| 2,823,743 | 2/1958 | Isaac | 160/39 |
| 3,091,658 | 5/1963 | Harmon | 248/61 |
| 3,166,286 | 1/1965 | Pfaff | 248/263 |
| 4,339,099 | 7/1982 | Barton et al. | 248/101 |
| 4,865,105 | 9/1989 | Peters | 160/38 |

FOREIGN PATENT DOCUMENTS

| | | | |
|---|---|---|---|
| 906094 | 9/1962 | United Kingdom | 248/251 |

*Primary Examiner*—David L. Talbott
*Assistant Examiner*—Derek Berger
*Attorney, Agent, or Firm*—Wallenstein, Wagner & Hattis, Ltd.

[57] ABSTRACT

A valance spacing assembly. The valance spacing assembly comprises a spacer bar 22 having opposed ends, a first and second clip 24 and 25, the first clip 24 removably attached at one end of the spacer bar 22, and the second clip 25 removably attached at an opposite end of the spacer bar 22, the first and second clips 24 and 25 each removably attached to two parallel spaced valance rods 12 and 14, thereby rigidly interconnecting the valance rods 12 and 14.

10 Claims, 1 Drawing Sheet

VALANCE SPACER ASSEMBLY

DESCRIPTION

1. Technical Field

This invention relates generally to hardware for hanging valance rod assemblies, and more particularly to a valance spacer assembly.

2. Background of the Invention

Valance assemblies are often used in connection with curtain assemblies to conceal the rods, hooks or hems by which curtains and drapes are suspended in front of windows. Valance assemblies also lend a decorative effect to the upper portion of curtains or drapes.

Valance assemblies usually consist of a drapery sleeve element made of fabric, two parallel spaced curtain rods mounted to a wall, and struts extending between the rods to maintain their parallel spacing. The rods are spaced apart at a distance slightly less than the height of the sleeve so that the rods may be inserted into the sleeve to form a header. The sleeve that runs along the rods may be shirred or folded for decoration.

The height of the valance will vary with the curtain rod assemblies and the taste of the owner. Therefore it is desirable that one may choose the spacing he or she desires at the location where the curtains are to be hung.

Previous attempts at providing such spacing have been disclosed in Basmadji, U.S. Pat. No. 4,662,421, entitled "Universal Valance Assembly," Ohman, U.S. Pat. No. 4,399,917, entitled "Dual Curtain Rod Assembly," and Pfaff, U.S. Pat. No. 3,166,286, entitled "Drapery Cornice Dual Rod nd Hanger Assembly."

Basmadji discloses a valance spacer that engages to the outside of a groover face element that holds decorative material. However, the length of the spacer bar is determined before installation and is not capable of field adjustment for length.

Similarly, Ohman discloses a spacer prefabricated to different lengths. Once again, this does not provide for field adjustment for height. Therefore, one could not make fine adjustments in the height of the valance, for example, to accommodate the taste of the owner or for changes in the size of the pocket due to cleaning.

Further, Ohman discloses a spacer bar made of relatively rigid material, yet the material must be pliable enough to snap into the C-shape channel of a conventional curtain rod. This pliability of the spacer bar may decrease the sturdiness of the valance assembly.

Pfaff discloses, in one embodiment, a C-shaped reinforcing member for a dual curtain rod assembly that requires one to use a machine screw to attach the reinforcing member to the curtain rod.

The present invention is provided to solve these and other problems.

SUMMARY OF THE INVENTION

It is an object of the present invention to provide an assembly for spacing and supporting valance rods where the spacing between the valance rods may be adjusted on location.

It is a further object of the present invention to provide a clip that connects a spacer bar to the outside of a valance rod so that no metal screws or other fasteners are needed for installation of a valance.

It is a further object of the present invention to provide a clip that removably attaches to the spacer bar and the valance rod. This enables one to remove the clip from the valance rod or spacer bar without any tools thereby making adjustment and installation easier.

According to the present invention, the valance spacer assembly comprises a spacer bar having opposed ends, and a first and second clip. The first clip removably attaches at one end of the spacer bar, and the second clip removably attaches at the opposite end of the spacer bar. Each clip has a means for removably attaching the spacer bar to a valance rod.

The clip has a body having first and second ends, and first and second lateral edges. The first end has a pair of flanges at its first and second lateral edges running from the first end and terminating at an intermediate portion of the body. The flanges are folded to form a first generally C-shaped collar with an axis centrally located.

One of the lateral edges of the first generally C-shaped collar has a portion removed proximate to the first end forming a notch. The resulting notch in the second lateral edge, as will be more fully discussed below, facilitates the initial alignment of the valance rod with the first C-shaped collar.

The second end of the body has its end folded in a generally arcuate hook toward a tongue deformed and bent from the body wall. The arcuate hook and tongue cooperate to form a second C-shaped collar with a centrally located axis essentially perpendicular to the axis of the first C-shaped collar.

To construct the valance spacer assembly, spacer bars are cut on location to the length that provides the desired spacing between the valance rods. One end of the spacer bar is removably inserted into the first C-shaped collar. The first C-shaped collar is dimensioned so that it presents an interference fit with the spacer bar.

The notch located at the first end of the body on the second lateral edge facilitates the initial alignment of the spacer bar with the first C-shaped collar. The notch will aid inserting the spacer bar into the first C-shaped collar even when they are not in perfect angular alignment. In addition, the notch accommodates a spacer bar with a rough edge or burr, that may result from cutting the spacer bar, so that the spacer bar may be inserted into the first C-shaped collar.

The opposite end of the spacer bar is similarly inserted into the first C-shaped collar of the second clip.

To rigidly interconnect two parallel spaced valance rods, the second C-shape collars on opposite ends of the spacer bar are then clipped about a circumferential portion of each rod.

DETAILED DESCRIPTION

Figure 1:
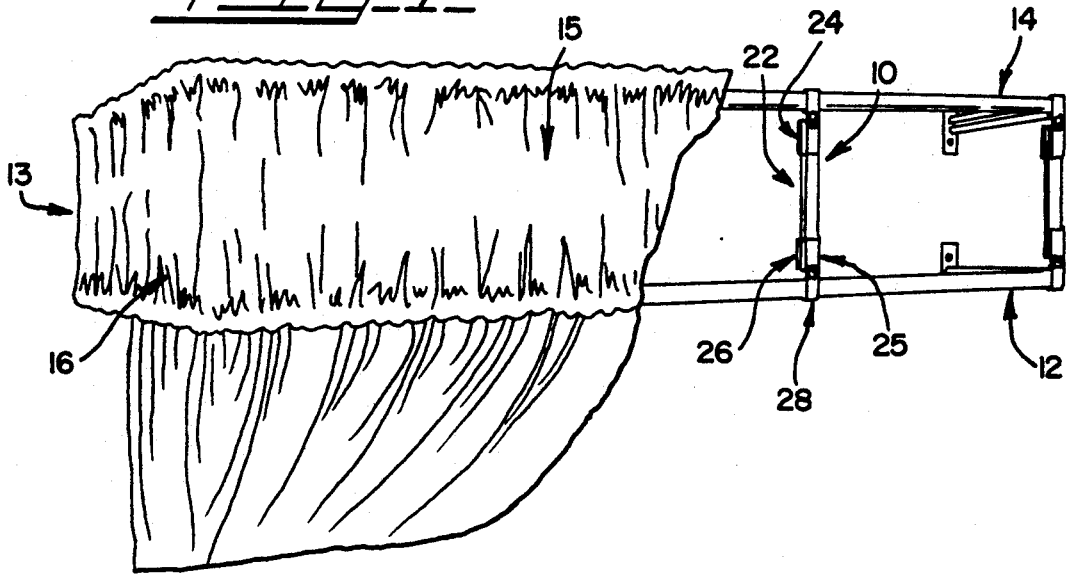
FIG. 1 is a perspective view of the present embodiment of the invention rigidly interconnecting two parallel spaced valance rods.

While this invention is susceptible of embodiment in many different forms, there is shown in the drawings and will herein be described in detail a preferred embodiment of the invention. The present disclosure is to be considered as an exemplification of the principles of the invention and is not intended to limit the broad aspect of the invention to the embodiment illustrated.

FIG. 1 shows the valance spacer assembly 10 interconnecting lower valance rod 12, that extends from the wall 13, and an upper valance rod 14 parallel to rod 12. This framework is intended to support a drapery sleeve element 15. The drapery sleeve element 15 may be composed of fabric or flexible material, which is folded back upon itself to form a pocket. The rods 12 and 14 are spaced at a distance slightly less than the height of the pocket so that the rods 12 and 14 may be inserted into the pocket and hold the fabric taut.

The length of the drapery sleeve element 15 may be greater than the length of the rods 12 and 14 so that the fabric may be folded 16 or ruffled along the rods 12 and 14 for a decorative effect.

The valance spacer assembly 10 comprises a spacer bar 22 and two clips 24, and 25, the clips 24 and 25 are preferably made of metal. The first end 26 of each clip 24 and 25, is attached to opposite ends of the spacer bar 22. The second end 28 of each clip 24 and 25 attach about a circumferential portion of the upper 14 and lower 12 valance rods, thereby rigidly interconnecting the rods.

Although the valance assembly 10 is shown attached to the front of the valance rods, the assembly 10 may be as easily attached to the rear of the valance rods.

Figure 2:
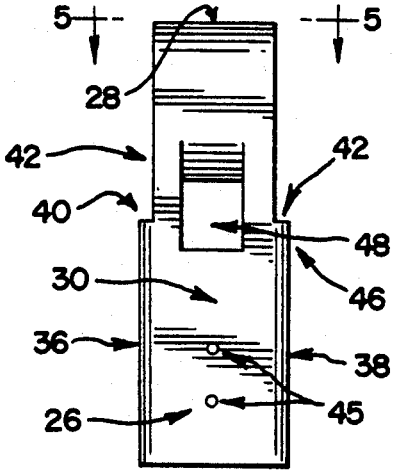
FIG. 2 is a plan view of the clip that connects the spacer bar to the valance rods.

FIG. 2 shows flat back 30 of clip 24 and 25, its first 26 and second 28 ends, and first 36 and second 38 opposed lateral edges. The first 36 and second 38 opposed lateral edges have a pair of flanges 40 and 42 that run from the first end 26 and terminate at an intermediate portion of the body 46.

The flanges 40 and 42 are folded toward one another to define a first generally C-shaped collar 44. The first collar 44 is more clearly shown in FIGS. 4 and 5. Two dimples 45 are stamped into the back 30 between the flanges 40 and 42. As will be discussed below, the dimples 45 provide friction with the spacer bar 22 to help form an interference fit with the spacer bar 22.

An intermediate portion of the back 48 is stamped out and bent away from the back 30 towards end 28 to form a tongue 50.

Figure 3:
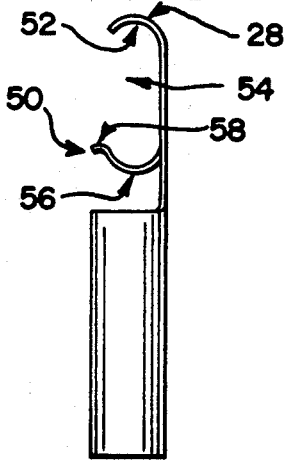
FIG. 3 is a side view of the clip.

Referring now to FIG. 3, the second ends 28 of both clips 24 and 25 are folded to form a generally arcuate hook 52 pointing toward the first end 26. The hook 52 and tongue 50 together form a second generally C-shaped collar 54. The tongue 50 is generally arcuate 56 in shape with a lip 58 at its distal end.

Figure 4:
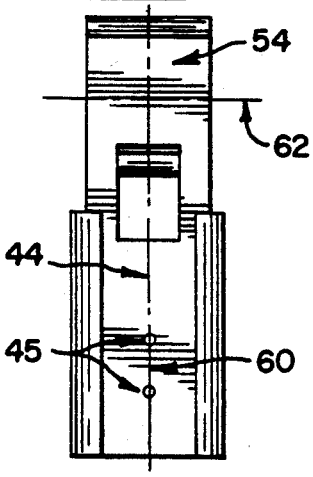
FIG. 4 is a bottom view of the clip.

FIG. 4 shows the first collar 44 with a first centrally located axis 60, and second collar 54 with a second centrally located axis 62 that is perpendicular to the first axis 60. Dimples 45 protrude from the back to form semi-spherical nodes.

Figure 5:
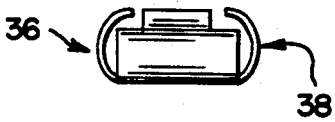
FIG. 5 is an end view of the clip.

FIG. 5 shows the flanges 36 and 38 folded to define the first C-shaped collar 44.

Figure 6:
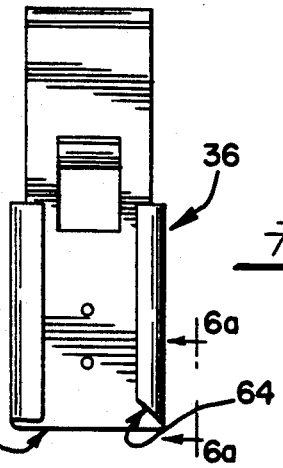
FIG. 6 is another embodiment of the clip.
Figure 6A:
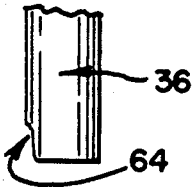
FIG. 6*a* is a break-away view taken along line 6*a* of FIG. 6.

Preferably, as shown in FIG. 6 and 6*a*, one of the lateral edges 38 of the first collar 44 has a portion removed proximate to the first end 26 to form a notch 64. The notch 64 accommodates initial angular misalignment of the spacer bar 22 with the first collar 44, and facilitates insertion of spacer bars with rough edges.

To construct the valance spacer assembly 10, the spacer bar 22 is cut to the length that will provide the desired spacing between the upper 14 and lower 12 valance rods. First collars 44 of clips 24 are inserted over opposite ends of the spacer bar 22. Collar 44 engages a circumferential portion of the spacer bar and is dimensioned to present an interference fit with the spacer bar 22. The two dimples 45 stamped into the back 30 provide friction with the spacer bar 22 to enhance the interference fit.

To rigidly interconnect two parallel spaced valance rods 12 and 14, the second collars 54 at opposite ends of the valance assembly 10 are clipped about a circumferential portion of the spaced valance rods 12 and 14 thereby connecting the rods.

The hook 52 and the tongue 50 of the second collar 54 cooperate to form an interference fit with the valance rods. The interference fit with the valance rod is formed when one edge of the valance rod is placed into the arcuate hook 52 and the opposite edge of the valance rod is rotated into the collar 54. The second edge of the rod initially engages the lip 58 at the distal end of the tongue 50. The tongue 50 bends back toward the first end 26 and the valance rod follows the arcuate shape 52 of the tongue 50 until the elasticity of the tongue material snaps the lip 58 back into position on the outer circumference of the valance rod.

The rod may be removed from the clip 24 by pressing the lip 58 toward the end 26 and pulling the clip 24 away from the rod. Accordingly, the valance assembly 10 may be removably attached to parallel spaced valance rods 12 and 14 without using any sheet metal screws or any tools.

The spacer bar 22 of the present embodiment, and the valance rods are generally C-shaped and made of conventional C-track curtain rod material like that sold by Graber Co. Model Number 9-200, and 9-201. Consequently, the collar 44 of the present embodiment is correspondingly generally C-shaped. The present invention also contemplates the use of spacer bars and valance rods of different dimensions and shapes, such as square and round shapes, and similarly shaped collars to accommodate these spacer bars, and valance rods.

In addition to allowing one to secure valance rods at any spaced-apart distance, the above described valance assembly allows one to substitute a spacer bar of one length for a spacer bar of another length, so that the valance assembly 10 may be used when changing the distance between two currently existing valance rods. This substitution may be accomplished without using any metal screws or without drilling holes in the curtain rods. Further, the above described valance assembly allows one to vary the distance between the rods to accommodate slight variations in the size of the curtain sleeve material that may be encountered in cleaning the material.

While the specific embodiments have been illustrated and described, numerous modifications come to mind without significantly departing from the spirit of the invention and the scope of protection is only limited by the scope of the accompanying claims.

I claim:

1. A valance spacer assembly comprising:

a spacer bar having opposed ends;

a first and second parallel spaced valance rods;

a first and second clip, said first and second clip each having a first and second C-shaped collar, said first C-shaped collar and said second C-shaped collar having a corresponding first and second centrally located axis, said first and second axis being essentially perpendicular to one another, said first C-shaped collar adapted to engage a circumferential portion of said spacer bar, and said second C-shaped collar adapted to engage a circumferential portion of a valance rod.

2. The assembly of claim 1, wherein said second collar is dimensioned to present an interference fit with a valance rod.

3. A clip for detachably connecting a valance spacer to a valance rod, comprising:

first and second C-shaped collars integral with one another, said first C-shaped collar being coplanar with said second C-shaped collar, said first C-shaped collar and said second C-shaped collar having corresponding first and second centrally located axes, said first and second axes being essentially perpendicular to one another, said first collar adapted to engage a circumferential portion of a spacer bar, and said second C-shaped collar adapted to engage a circumferential portion of a valance rod.

4. A clip for detachably connecting a valance spacer to a valance rod comprising:

a body having a generally flat back, first and second opposed ends, and first and second opposed lateral edges;

said first end of said body having a pair of flanges at said lateral edges running from said first end and terminating at an intermediate portion of said body, said flanges being folded toward one another to form a first generally C-shaped collar, said first C-shaped collar having a first axis centrally located, said first C-shaped collar adapted to circumferentially engage around an end portion of a spacer bar;

said second end of said body having said second end curled toward a tongue deformed from an intermediate portion of said back of said body, said second end and said tongue defining a second C-shaped collar, said second C-shaped collar having a second axis centrally located and essentially perpendicular to the first axis, said second C-shaped collar being adapted to circumferentially engage around a portion of a valance rod.

5. The clip of claim 4, wherein said tongue deformed from said back of said body is generally arcuate in shape with a lip at its distal end.

6. The clip of claim 4, wherein said body is made of metal.

7. The clip of claim 4, wherein said first end of said body has a dimple stamped from said back at an intermediate portion of said body, said dimple providing friction with said spacer bar.

8. The clip of claim 4, wherein said first generally C-shaped collar is dimensioned to present an interference fit with said spacer bar.

9. The clip of claim 4, wherein one of said lateral edges of said first C-shaped collar having a portion removed proximate said first end of said body to define a notch.

10. The clip of claim 4, wherein said second generally C-shaped collar is dimensioned to present an interference fit with said valance rod.

* * * * *